United States Patent [19]

Noelle

[11] 4,338,185

[45] Jul. 6, 1982

[54] RECOVERY OF OIL FROM OIL SANDS

[76] Inventor: Calvin D. Noelle, 1900 South Ocean Blvd., #14D, Pompano Beach, Fla. 33062

[21] Appl. No.: 222,129

[22] Filed: Jan. 2, 1981

[51] Int. Cl.[3] ..... C10G 1/04
[52] U.S. Cl. ..... 208/11 LE
[58] Field of Search ..... 208/11 LE

[56] References Cited

U.S. PATENT DOCUMENTS 3,660,268 5/1972 Kelly ..... 208/11 LE
3,951,778 4/1976 Willard ..... 208/11 LE

FOREIGN PATENT DOCUMENTS 680576 2/1964 Canada ..... 208/11 LE
2044796 10/1980 United Kingdom ..... 208/11 LE

*Primary Examiner*—Delbert E. Gantz
*Assistant Examiner*—Joseph A. Boska
*Attorney, Agent, or Firm*—Joseph Zallen

[57] ABSTRACT

In the method of recovering oil from oil sand wherein the oil sand is tumbled in an aqueous alkaline solution to form a floating mass in which the oil is dispersed and the oil then recovered from the mass, the step of including in the aqueous alkaline solution 0.3 to 100 parts per million of a water-soluble member of the group consisting of anionic polyelectrolytes having a low molecular weight, acrylic acid, mannuronic acid and the sodium salts thereof.

4 Claims, No Drawings

RECOVERY OF OIL FROM OIL SANDS

BACKGROUND OF THE INVENTION

This invention relates to the extraction of oil from oil sand. In particular it relates to an improvement whereby a higher proportion of the oil is recovered and less goes into the effluent. The term "oil" as used herein is intended to be used in its generic sense and would include bitumen and tar.

A method has been described for recovering oil from oil sand in which the oil sand is tumbled in an aqueous alkaline solution to form a floating mass which contains oil. The floating mass can be froth or a slurry. In most cases there are at least two frothing or flotation tanks where typically the slurry or foam is fed into a first tank at about 180° F. and the sand and clay allowed to settle. The mixture of oil sand and aqueous alkali which forms on the top of the solution is a froth, emulsion or flotation fed to a second tank for further tumbling and settling. In the second stage more water is generally added and the temperature generally increased to about 200° F. U.S. Pat. Nos. 3,330,757 and 3,893,907 are patents which deal with this general method. Most of the sand and clay is drained off the bottom of the tanks and the emulsion, slurry, froth or flotation, which contains the oil, is then skimmed off the top and passed into a naphtha solution for dissolving the oil. The naphtha step is typically followed by centrifuging to remove any sand or clay that may have carried over. The effluent line typically draws commonly both from the tanks and the centrifuge. The naphtha is separated from the oil by distillation.

One problem with this method is that some of the oil does not go into the froth or floatation and thus ends up in the effluent lines with consequent pollution of the down stream.

One object of the present invention is to provide an improvement on this method which will increase the amount of oil going into the froth or flotation and decrease the amount of oil going into the effluent.

Other objects and advantages of this invention will be apparent from the description and claims which follow.

SUMMARY OF THE INVENTION

The invention comprises broadly modifying the aqueous alkaline tumbling and flotation separation by including in the aqueous alkaline solution 0.3 to 100 ppm of water-soluble lowmolecular weight anionic compounds. The compounds are preferably selected from the group consisting of anionic polyelectrolytes, acrylic acid, methacrylic acid, mannuronic acid and sodium salts thereof. It is preferred that the molecular weight be below 1,000,000.

Examples of polyelectrolytes useful in this invention are:

polyacrylic acid
polymethacrylic acid
alginic acid
sodium salt of polyacrylic acid
sodium salt of polymethacrylic acid
sodium salt of alginic acid In some instances, particularly where the available water has a low mineral content, it is helpful to add to the solution water-soluble salt of polyvalent metals such as magnesium, aluminum and iron in amounts totalling less than 100 ppm.

I am not aware of any prior art which teaches the use of such polyelectrolytes to form froths with higher oil contents. I am aware of the use of similar polymers as flocculants (U.S. Pat. Nos. 3,723,310 and 4,069,152) to settle finely-divided clay as well as alkaline oxide polymers for a similar purpose (U.S. Pat. No. 2,957,818.) I am also aware of the use of surfactants and solvents to break emulsions. (U.S. Pat. Nos. 2,910, 424, 3,330,757, 3,584,829 and 3,893,907. ) However, I know of no prior art which suggests the use of water-soluble, low molecular weight anionic compounds to increase the oil in a froth or flotation.

The compounds of this invention are preferably used individually, but can be used in combination if they are compatible with one another and do not inter-react to any significant extent.

I believe that the water-soluble, low molecular weight anionic compounds of my invention function by adsorption, which involves simple electrostatic force rather than true covalent bonds. The water and oil produce emulsified droplets which carry negative charges. I believe that the compounds are adsorbed on to these and other particles thus more effectively repelling emulsified oil droplets. More oil is thereby dispersed than settled with the solids which go into the effluent stream.

Polyacrylic and polymethacrylic acids and their sodium salts are most effective as homopolymers. However they are still useful in this invention if modified by comonomers, such as acrylamide or methacrylamide, provided that the proportion of such comonomer does not exceed 50% of the total monomer content.

SPECIFIC EXAMPLE OF INVENTION

EXAMPLE 1

A low molecular-weight anionic polyelectrolyte compound suitable for use in alkaline tumbling of oil sand is made by reacting three parts by weight of sodium alginate (e.g. Keltex by Merck) with 37 parts by weight of 76% flake sodium hydroxide and 60 parts by weight of water. The sodium alginate is first dispersed into the water to form a gel and then the flake caustic soda is added without additional heating since the reaction is exothermic.

When this compound was added to the aqueous alkaline tumbling solution for the oil sand, in an amount of 0.3 to 100 ppm a significant decrease in the amount of oil in the effluent was found.

EXAMPLE 2

Another anionic compound I found suitable for use in this invention is the sodium salt polyacrylic acid, made by reacting sodium hydroxide with low molecular weight polyacrylic acid (e.g. Acrysol A-1 by Rohm & Haas).

I claim:

1. In the method of recovering oil from oil sand wherein the oil sand is tumbled in an aqueous alkaline solution to form a floating mass in which the oil is dispersed and the oil then recovered from the mass, the step of including in the aqueous alkaline solution 0.3 to 100 parts per million of a water-soluble low molecular weight anionic compound selected from the group consisting of alginic acid, mannuronic acid and the sodium salts thereof.

2. Method of claim 1 wherein the compound is sodium alginate.

3. The method of claims 1, or 2 wherein the aqueous alkaline solution contains up to 100 parts per million of watersoluble polyvalent metallic salts.

4. The method of claims 1, or 2 wherein the aqueous alkaline solution contains up to 100 parts per million of water-soluble magnesium, aluminum or iron salts.

* * * * *